US007891905B2

(12) United States Patent
Couture

(10) Patent No.: US 7,891,905 B2
(45) Date of Patent: Feb. 22, 2011

(54) RAILING INSTALLATION APPARATUS AND METHOD

(75) Inventor: Steeve Couture, Beauceville (CA)

(73) Assignee: Carl Couture, Beauceville, QC (CA)

( * ) Notice: Subject to any disclaimer, the term of this patent is extended or adjusted under 35 U.S.C. 154(b) by 0 days.

(21) Appl. No.: 12/143,995

(22) Filed: Jun. 23, 2008

(65) Prior Publication Data

US 2008/0317550 A1 Dec. 25, 2008

Related U.S. Application Data

(60) Provisional application No. 60/945,602, filed on Jun. 22, 2007.

(51) Int. Cl.
*E01C 19/00* (2006.01)

(52) U.S. Cl. ..... 404/83; 198/312; 414/349

(58) Field of Classification Search ..... 404/83, 404/84.05; 198/312; 414/349, 433
See application file for complete search history.

(56) References Cited

U.S. PATENT DOCUMENTS 7,393,156 B1 * 7/2008 Dunstan ..... 404/83

FOREIGN PATENT DOCUMENTS

| | | | |
|---|---|---|---|
| EP | 1 319 757 | * | 6/2003 |
| JP | 6-9198 | * | 1/1994 |
| JP | 7-3737 | * | 1/1995 |
| JP | 9-315296 | * | 12/1997 |

* cited by examiner

*Primary Examiner*—Gary S Hartmann
(74) *Attorney, Agent, or Firm*—Ogilvy Renault LLP

(57) ABSTRACT

A railing installation apparatus comprises a support platform adapted to be displaced alongside a road. An installation unit is connected to the support platform. The installation unit comprises a feed conveyor unit feeding rails to a carriage unit. The carriage unit is actuated to orient rails to an installation position against posts, and to twist a series of rails connected at one end to the posts to an overlapping position with rails in the feed conveyor unit for end-to-end attachment of the rails.

5 Claims, 10 Drawing Sheets

RAILING INSTALLATION APPARATUS AND METHOD

CROSS-REFERENCE TO RELATED APPLICATION

This patent application claims priority on U.S. Provisional Patent Application No. 60/945,602, filed on Jun. 22, 2007.

FIELD OF THE APPLICATION

The present application relates to installation of roadside railing, and more particularly to an apparatus used in the installation of rails to posts.

BACKGROUND ART

The installation of roadside railing is a labor-intensive operation, that involves operators supporting and handling rails so as to secure these rails to posts. There are ergonomic issues associated with this type of operation, as operators must show strength to be capable of repeatedly supporting the rails, while having to show dexterity in aligning rails to secure them to one another and fix them to posts.

SUMMARY

It is therefore an aim of the present disclosure to provide a railing installation apparatus that addresses issues associated with the prior art.

It is a further aim of the present disclosure to provide a method for installing railing that addresses issues associated with the prior art.

Therefore, in accordance with the present invention, there is provided a railing installation apparatus comprising: a support platform adapted to be displaced alongside a road; an installation unit connected to the support platform, the installation unit comprising: a feed conveyor unit feeding rails to a carriage unit; and the carriage unit being actuated to orient rails to an installation position against posts, and to twist a series of rails connected at one end to said posts to an overlapping position with rails in the feed conveyor unit for end-to-end attachment of the rails.

Further in accordance with the present invention, there is provided a method for installing rails on posts, comprising the steps of: providing a sequence of at least two rails secured end to end; fastening an end of one of the rails to a post; and twisting the sequence such that a free end is in position to be secured to an end of another rail.

DESCRIPTION OF THE PREFERRED EMBODIMENTS

Figure 1:
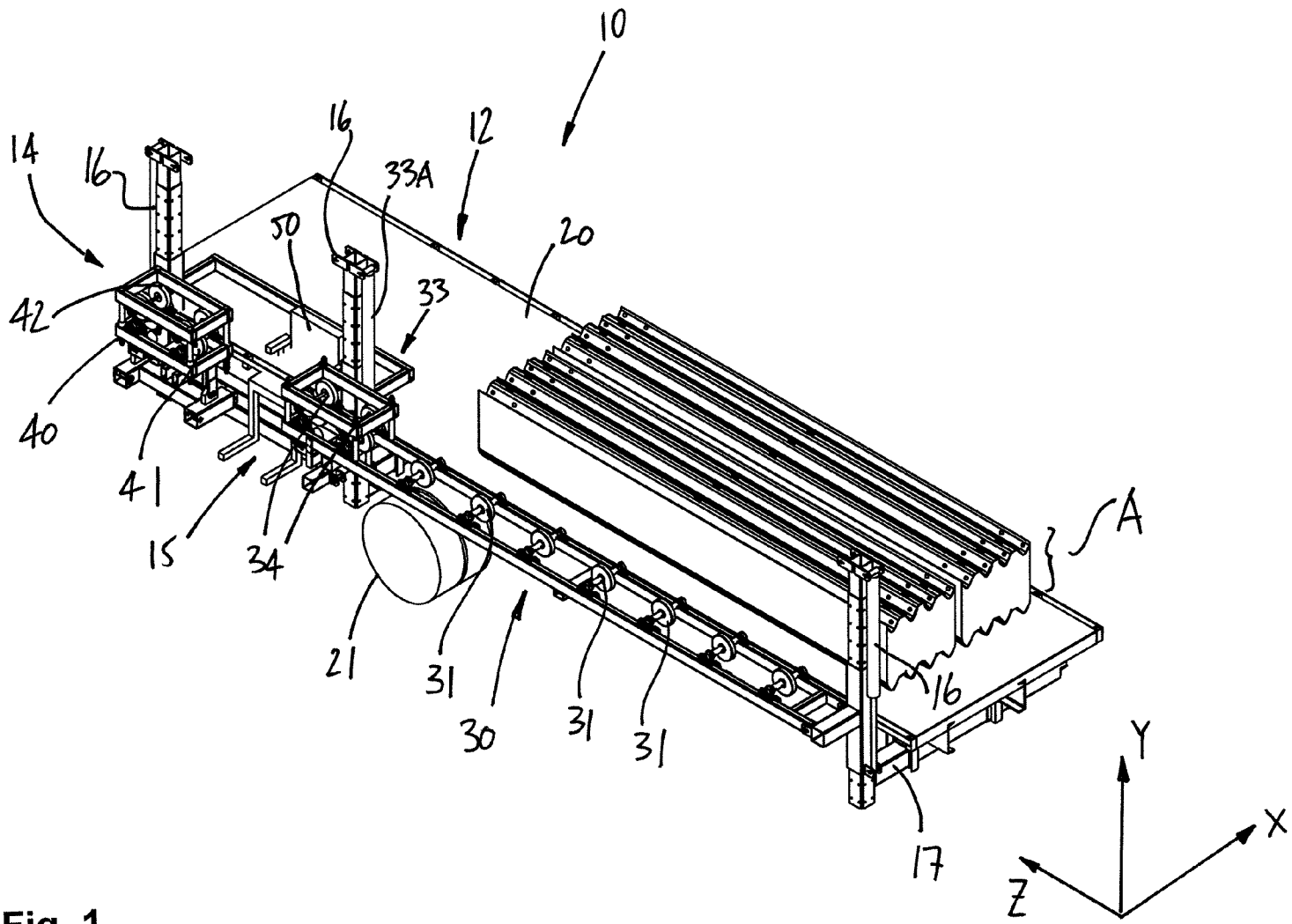
FIG. 1 is a perspective view of a railing installation apparatus in accordance with an embodiment of the present disclosure.
Figure 2:
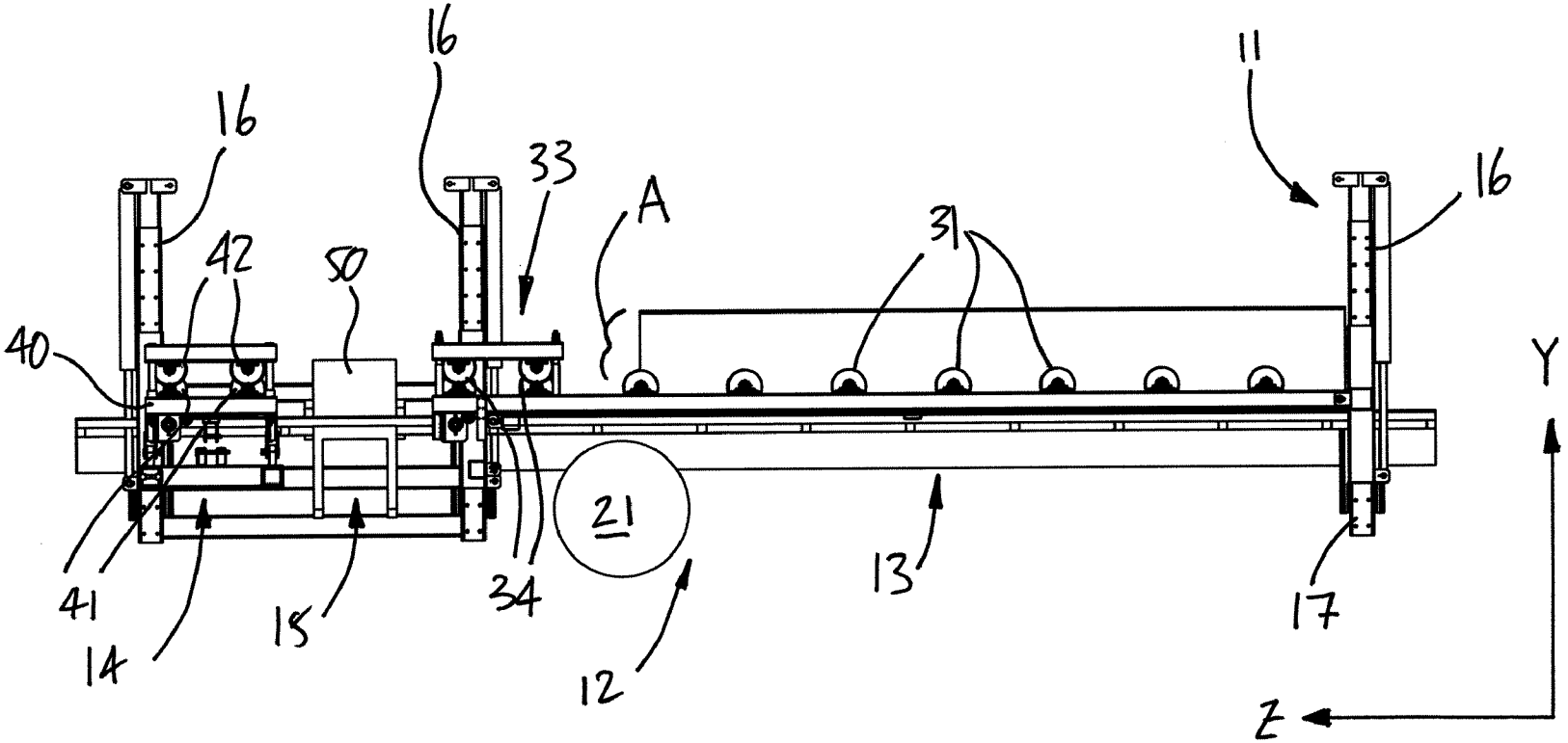
FIG. 2 is a side elevation view of the railing installation apparatus of FIG. 1.

Referring now to the drawings, and more particularly to FIG. 1, a railing installation apparatus is generally shown at 10. The apparatus 10 has an installation system 11 and a trailer 12.

The installation system 11 is used to provide assistance to operators installing the rails, by supporting the weight of the rails to reduce the involvement of the operators in such tasks.

The trailer 12 supports the installation system 11 and is displaceable alongside the road as the railing is being installed. The trailer 12 supports the stacks of rails A on platform 20 prior to their being installed. In the illustrated embodiment, the trailer 12 is a flat bed that is connected to a motorized vehicle (not shown), but may also be an integral platform of a vehicle (e.g., a truck). Wheels 21 are illustrated in FIG. 1.

The installation system 11 has a feed conveyor unit 13, a carriage unit 14 and an operator station 15 between the feed conveyor unit 13 and the carriage unit 14.

The feed conveyor unit 13 is used to supply rails from the stack of rails A to the carriage unit 14.

Figure 8:
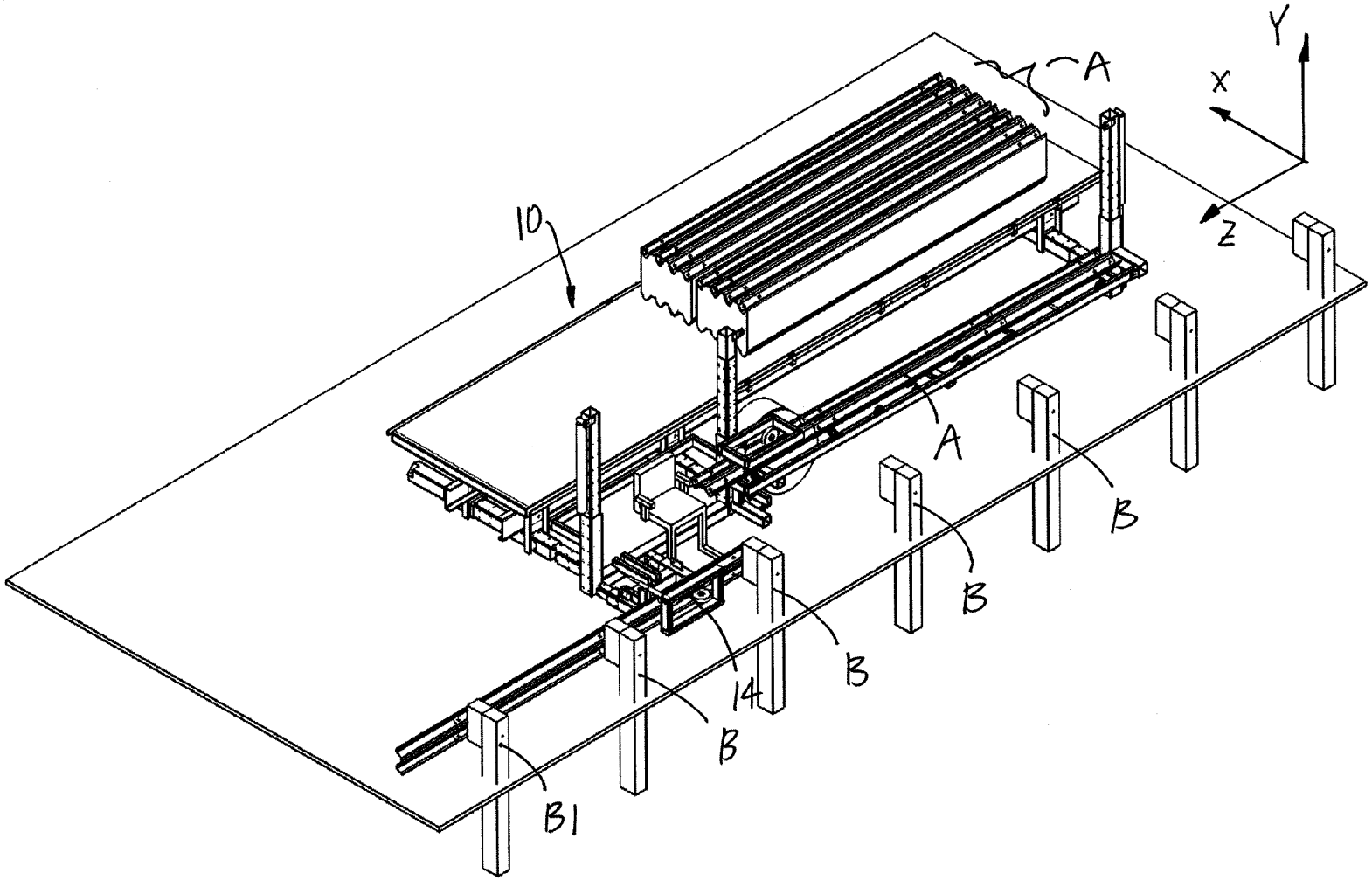
FIG. 8 is a perspective view of the railing installation apparatus of FIG. 1, during the installation of railing along a road.

The carriage unit 14 relates the rails A (1) that are connected end to end and mounted to the vertical posts B (FIG. 8) to (2) rails A being individually fed by the feed conveyor unit 13. The carriage unit 14 orients the rails A toward their installation orientation against the posts B (FIG. 8).

The operator station 15 is positioned between the feed conveyor unit 13 and the carriage unit 14, for an operator to secure rails in end-to-end fashion. Moreover, the operator station 15 features the controls by which the operator will actuate various movements of the installation system 11 and the carriage unit 14.

Figure 5:
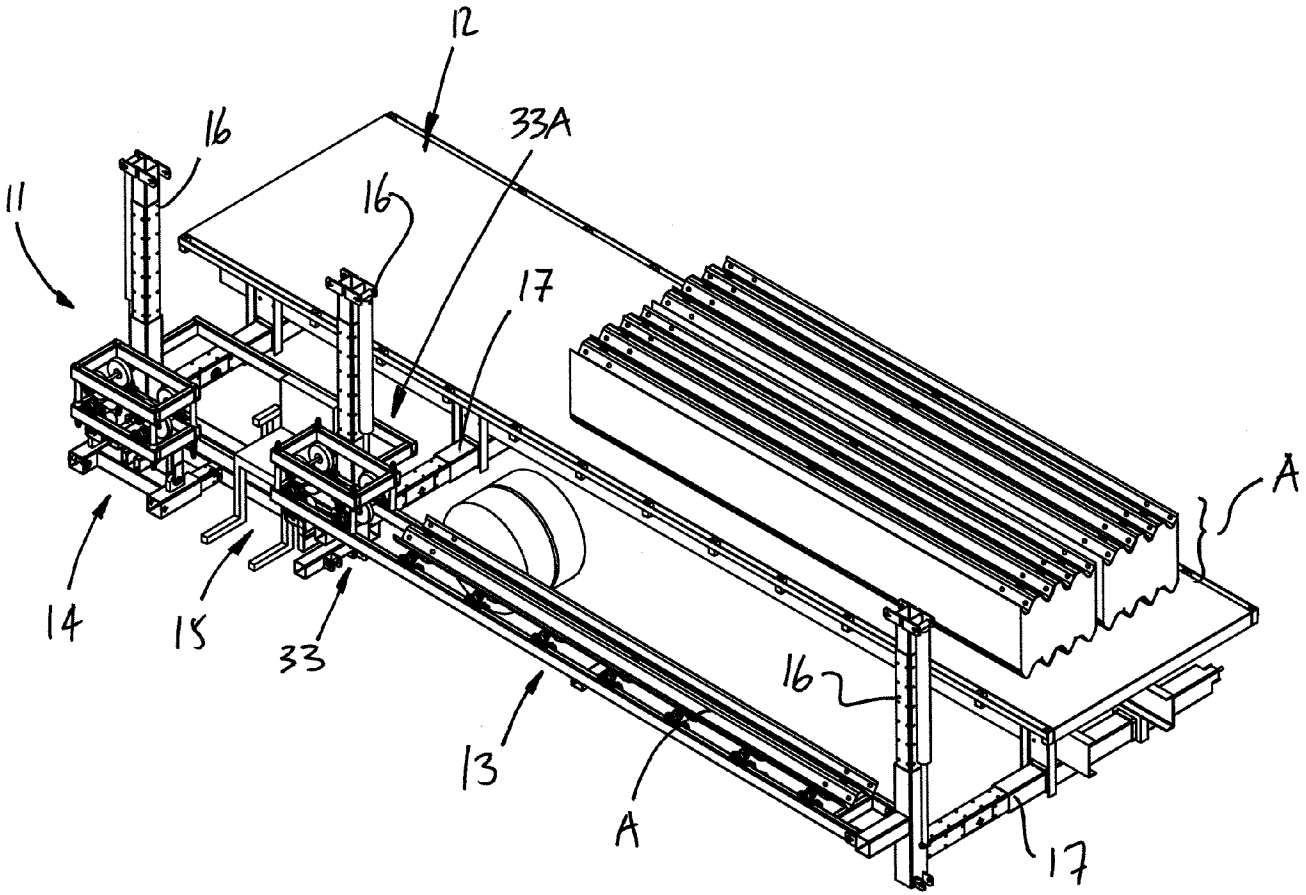
FIG. 5 is a perspective view of the railing installation apparatus of FIG. 1, with an installation system extended horizontally and with a rail on a feed conveyor unit.

The installation system 11 is displaceable horizontally (i.e., along the X-axis) and vertically (i.e., along the Y-axis) with respect to the trailer 12. More specifically, the installation system has a vertical displacement mechanism 16 and a horizontal displacement mechanism 17, such that the feed conveyor unit 13, the carriage unit 14 and the operator station 15 can all be displaced simultaneously. In the illustrated embodiment, the displacement mechanisms 16 and 17 involve telescopic members and hydraulic cylinders, but other similar systems may be used as well. In FIG. 5, the installation system 11 is shown in an extended position along the X-axis.

Figure 3:
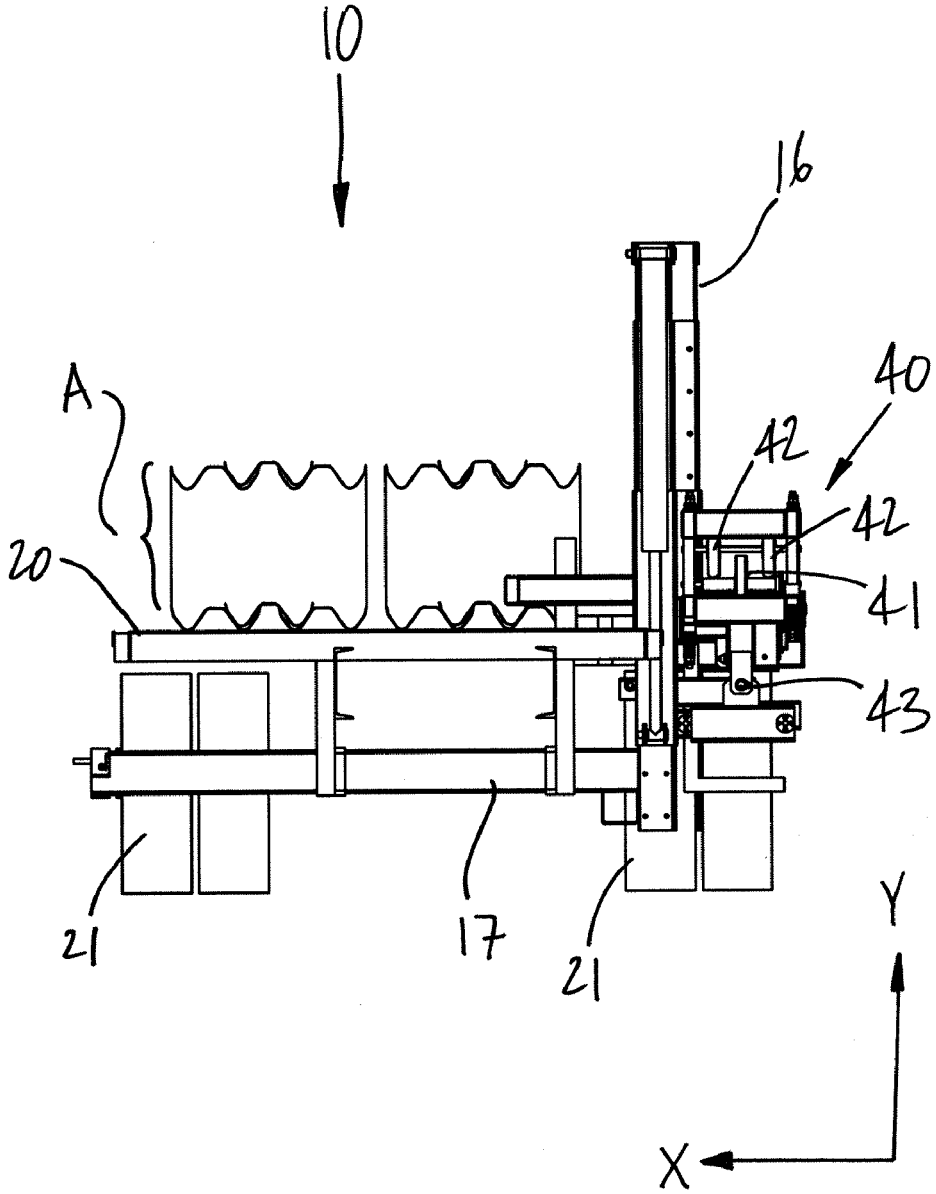
FIG. 3 is a rear elevation view of the railing installation apparatus of FIG. 1.
Figure 4:
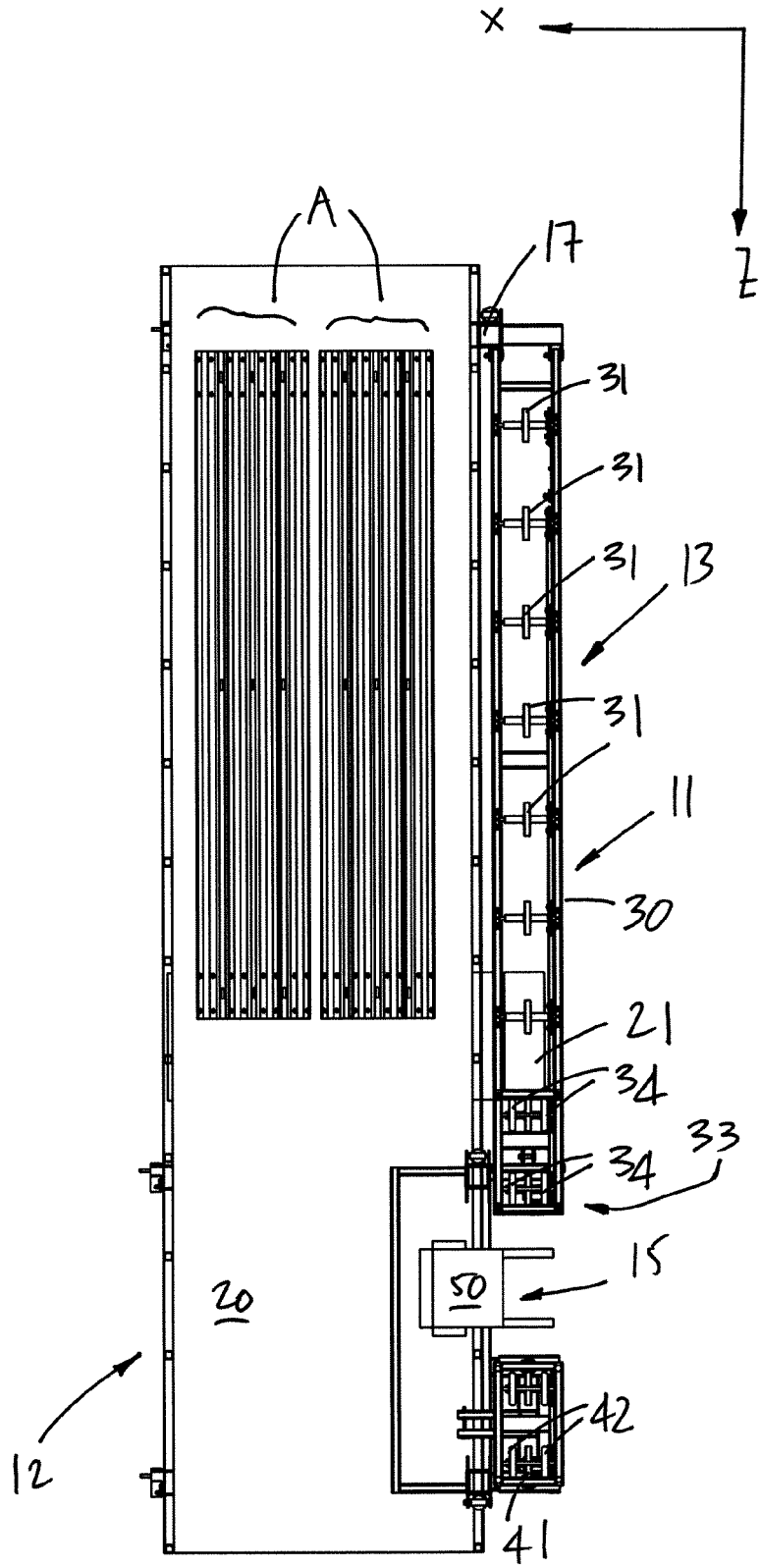
FIG. 4 is a top plan view of the railing installation apparatus of FIG. 1.

Referring concurrently to FIGS. 1 to 4, the feed conveyor unit 13 is shown having a conveyor 30 having a series of inline rollers 31. The rollers 31 are idler rollers (some of which are optionally actuated) that support rails, as is seen in FIG. 5. The rails are typically of the type having a sinusoidal section, with two valleys and a ridge, as is best seen in FIG. 3. When the rail A is on the conveyor 30, the rollers 31 are accommodated in the underside of the ridge, whereby the rail A can simply be manually displaced along the conveyor 30 (i.e., in direction of the Z-axis).

A stabilizing unit 33 is positioned at a downstream end of the conveyor 30. The stabilizing unit 33 is a structure supporting additional rollers 34 that are above the rollers 31. The rollers 34 are positioned so as to be accommodated in the valleys of the rails A, as is shown FIG. 6. By having rollers 31 and 34 in the valleys and ridge, the rail A in the stabilizing unit 33 will be prevented from moving in the X-axis and in the Y-axis. It is pointed out that the additional rollers 34 may be positionable to a set position to adjust the stabilizing unit 33 to different sizes of rails A. The stabilizing unit 22 has a telescopic support 33A, by which the stabilizing unit 33 can be displaced vertically (along the Y-axis).

Figure 6:
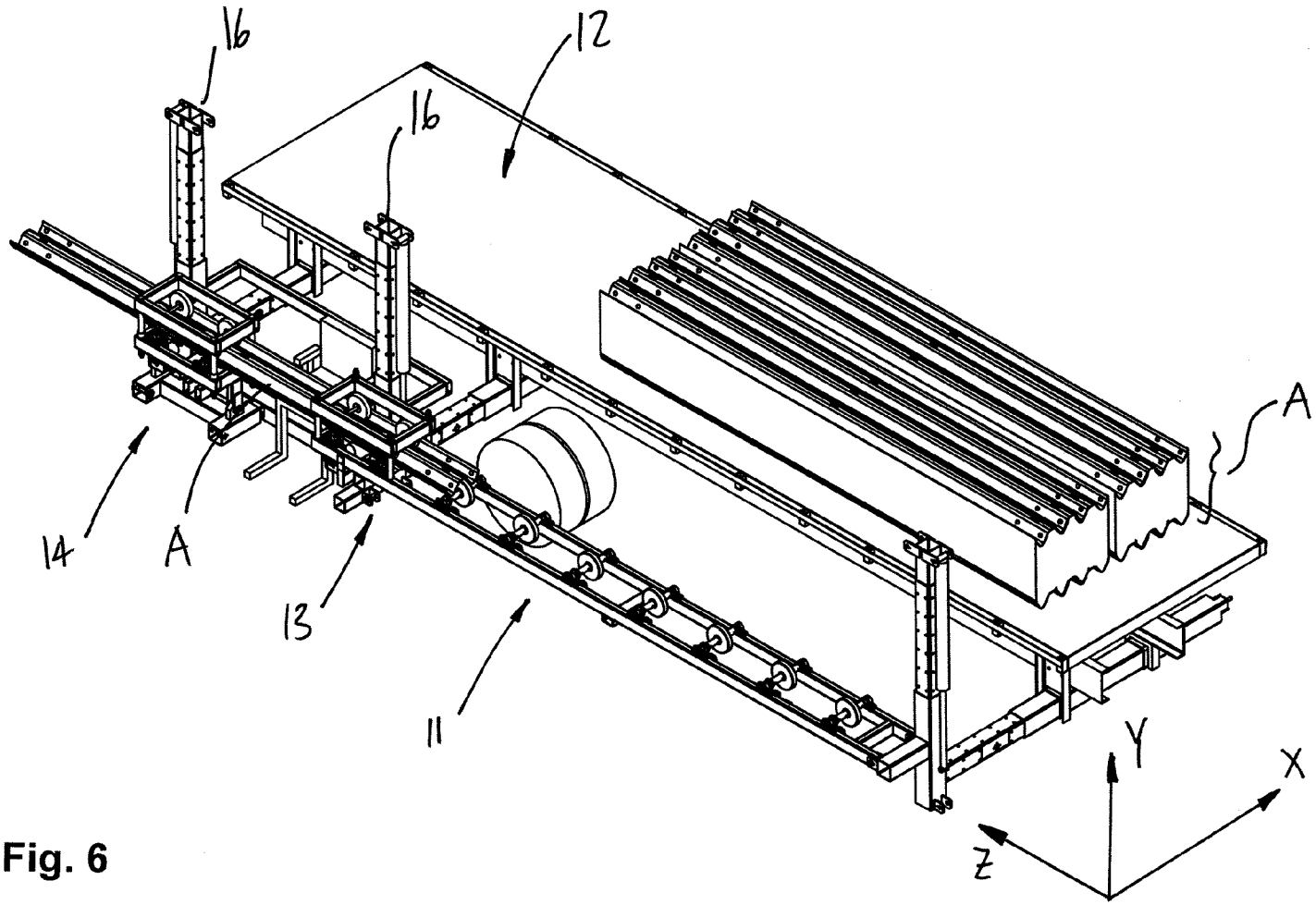
FIG. 6 is a perspective view of the railing installation apparatus of FIG. 5, with the rail reaching a carriage unit.
Figure 7:
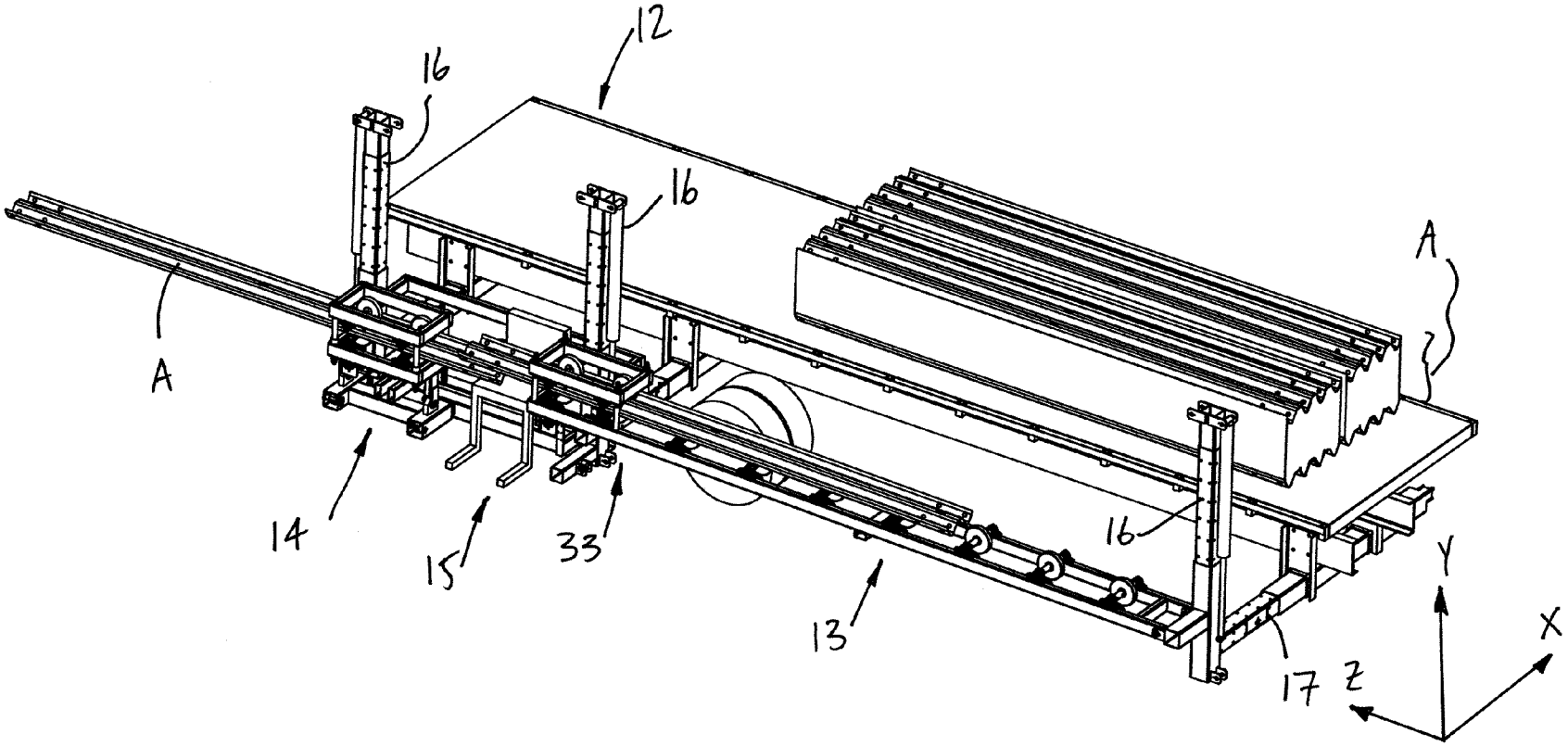
FIG. 7 is a perspective view of the railing installation apparatus of FIG. 6, with rails on the carriage unit and the feed conveyor unit.

Referring concurrently to FIGS. 1 to 4, the carriage unit 14 is in alignment with the conveyor 30 to allow rails A to be transferred from the conveyor 30 to the carriage unit 14. The carriage unit 14 has a structure 40 that supports lower rollers 41 (in line with the rollers 31 of the conveyor 30), and upper rollers 42 (in line with the additional rollers 34 of the stabilizing unit 33). The rollers 42 are positioned so as to be accommodated in the valleys of the rails A, whereas the lower rollers 41 are in the underface of the ridge as is shown in FIGS. 6 and 7. Therefore, when a rail A is in the carriage unit 14, it is prevented from moving in the directions of the X-axis and the Y-axis.

The structure 40 of the carriage unit 14 is pivotally mounted to a remainder of the installation system 11. More specifically, the structure 40 of the carriage unit 14 is mounted to a remainder of the installation system by a pivot joint 43. Therefore, the structure 40 of the carriage unit 14 is pivotable to an installation position, as illustrated in FIG. 8. The degree of rotation of the structure 40 of the carriage unit 14 about the Z-axis is actuated by hydraulic cylinders or a motor (not shown).

The structure 40 of the carriage unit 14 also has a telescopic support 44 (FIG. 3), by which the structure 40 can be displaced vertically (along the Y-axis), independently of the feed conveyor unit 13. The structure 40 can also be displaced horizontally (along the X-axis) to facilitate the installation of rails A. The horizontal displacement is independent from the horizontal displacement of a remainder of the installation system 11.

The operator station 15 has a seat 50. When seated, an operator is between the stabilizing unit 33 and the carriage unit 14. Although not shown, it is contemplated to provide a control unit for the operator to control the horizontal and vertical position of the installation system 11, as well as the orientation of the structure 40 of the carriage unit 14.

Now that the components of the railing installation apparatus 10 have been described, an installation of rails to posts is explained.

It has been noted that rails A can be twisted. More specifically, when two or three rails A are secured end to end, it has been tested that such an assembly of rails A can be twisted along the longitudinal axis by at least 90 degrees. Accordingly, referring to FIG. 8, while one end of a sequence of end-to-end rails A is secured to a post B1 amongst posts B, the free end that is supported by the carriage unit 14 can be twisted to the position illustrated in FIG. 7. Therefore, the installation system 11 is used to interconnect rails A in end-to-end fashion.

In an embodiment, the installation takes place in the following order. The apparatus 10 is positioned adjacent to posts B, and the vertical and horizontal displacement mechanisms 16 and 17 are actuated to position the installation system 11 close to posts B (FIG. 8).

Referring to FIG. 5, a rail A is positioned on the conveyor 30, and is moved along the Z-axis, through the operator station 15 (FIG. 6), and into the carriage unit 14. When the rail A is out of the feed conveyor unit 13 and fully supported by the carriage unit 14, the carriage unit 14 is pivoted to the position illustrated in FIG. 8.

Simultaneously, another one of the rails A is positioned on the conveyor 30 and is moved along the Z-axis. As a portion of the rail A extends out of the stabilizing unit 33 of the feed conveyor unit 13, it overlaps the end of the rail A that is supported by the carriage unit 14, as is shown in FIG. 7. When a pair of rails A overlap as is illustrated in FIG. 7, the operator interconnects the rails A, using appropriate fasteners.

The connected rails A are then displaced along the Z-axis, with the downstream rail A moving out of the carriage unit 14, for the upstream rail A moving into the carriage unit 14 to be secured in end-to-end fashion with a subsequent rail A.

When a sufficient number of rails A extend out of the carriage unit 14 toward the rear of the trailer 12, another operator may start securing the rails A to the posts B. As is shown in FIG. 8, the carriage unit 14 is pivoted to the installation position, whereby the rails A extending out of the carriage unit 14 can be connected to posts using appropriate fasteners. The various degrees of freedom of the installation system 11 allow the rails A to be positioned properly with respect to the posts.

When the rails A are fastened to the posts B, it is necessary that a suitable length of rails from the carriage unit 14 not yet be secured to posts. As is shown in FIG. 8, between post B1 and the carriage unit 14, the rails A are not fastened to the posts B. Accordingly, the carriage unit 14 is pivoted back to the position illustrated in FIG. 7, thereby twisting a series of rails A as described above, such that an additional rail A may be installed in end-to-end fashion with the sequence of rails A downstream of the operator station 15. The trailer 12 is displaced along the road as the sequence of rails A is installed to the posts.

Figure 9:
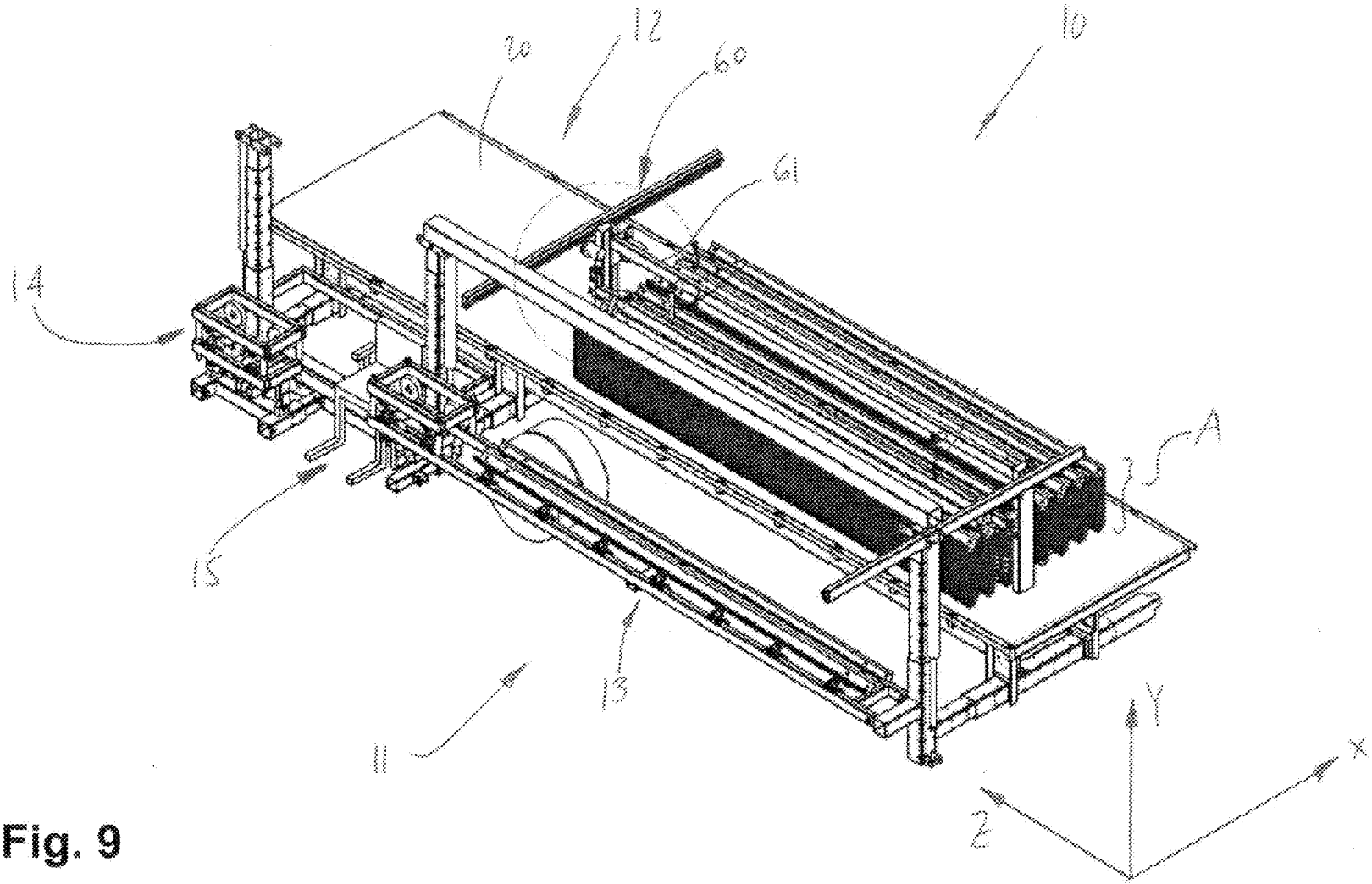
FIG. 9 is a perspective view of the railing apparatus of FIG. 1, having an optional loading system.
Figure 10:
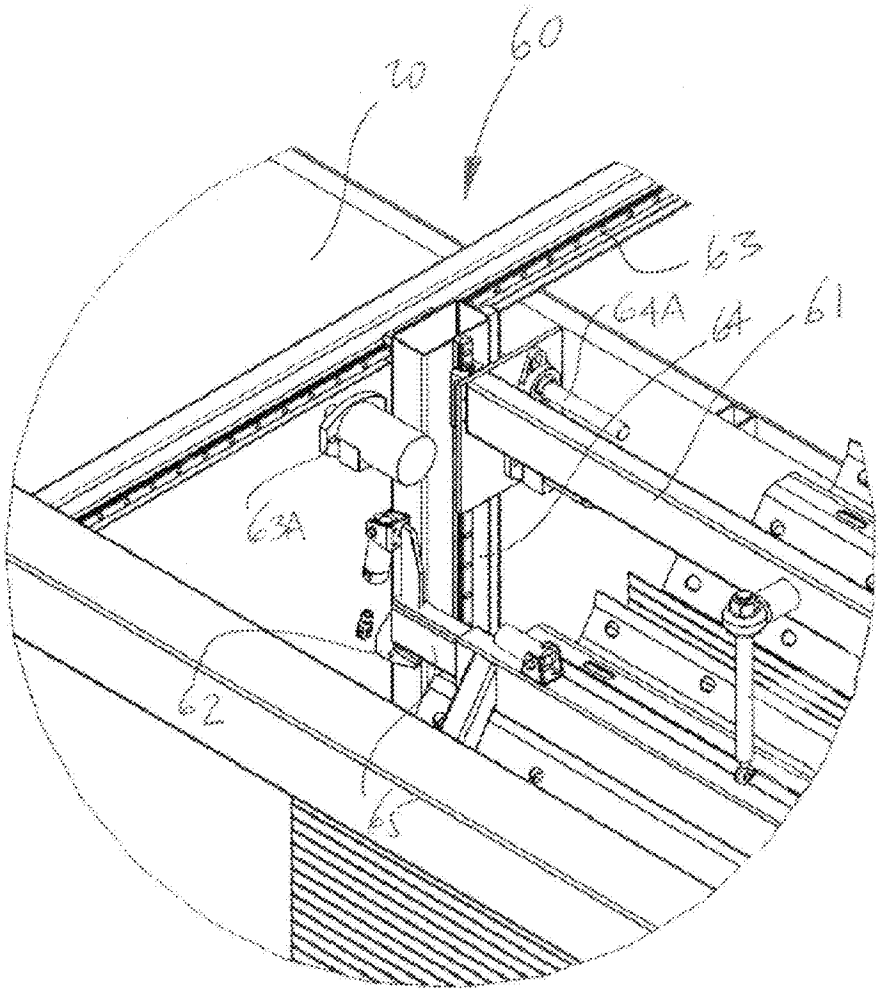
FIG. 10 is an enlarged perspective view of the loading system of FIG. 9.

Referring concurrently to FIGS. 9 and 10, the railing installation apparatus 10 is illustrated as being equipped with a loading system 60. The loading system 60 is mounted to the horizontal displacement mechanism 17 and is positioned adjacent to the feed conveyor unit 13. The loading system 60 feeds rails A from the stack to the feed conveyor unit 13.

The loading system 60 is in the form of a bridge crane that has a support beam 61 with fingers 62 projecting downwardly therefrom. The support beam 61 translates horizontally and vertically, thus along the X-axis and the Y-axis. These translations are actuated by horizontal actuator 63 (e.g., a rack and pinion assembly with motor 63A) and vertical actuator 64 (e.g., a rack and pinion assembly with motor 64A). Actuatable clamps 65 are provided at the bottom end of the fingers 62 to separate then grasp the uppermost rail A from the stack, then raise the rail A, move the rail A to alignment with the feed conveyor unit 13, and lower the rail A onto the feed conveyor unit 13.

The invention claimed is:

1. A railing installation apparatus comprising:

a support platform adapted to be displaced alongside a road;

an installation unit connected to the support platform, the installation unit comprising:

a feed conveyor unit feeding rails to a carriage unit; and the carriage unit having upper and lower rollers between which rails are sandwiched, so as to limit movement of a rail with respect to the carriage unit to a feeding direction, the carriage unit being actuated to orient rails to an installation position against posts, and to twist a series of rails connected at one end to said posts to an overlapping position with rails in the feed conveyor unit for end-to-end attachment of the rails.

2. The railing installation apparatus according to claim 1, further comprising actuatable translational joints between the installation unit and the support platform, whereby the installation unit is displaceable in height and laterally with respect to the support platform.

3. The railing installation apparatus according to claim 1, wherein an end of the feed conveyor unit has a upper and lower rollers between which rails are sandwiched, so as to limit movement of a rail to a feeding direction.

4. The railing installation apparatus according to claim 1, wherein the support platform is part of a trailer.

5. The railing installation apparatus according to claim 1, wherein an operator station is provided between the feed conveyor unit and the installation unit to manually perform the end-to-end attachment of the rails in the overlapping position.

* * * * *